United States Patent [19]

Gerardis et al.

[11] Patent Number: 5,005,502

[45] Date of Patent: Apr. 9, 1991

[54] SEWING MACHINE FOR HEMMING ARTICLES

[75] Inventors: Patrick Gerardis, Guildford; John Tester, Mt Pritchard, both of Australia

[73] Assignee: Adapt Engineering Pty. Limited, New South Wales, Australia

[21] Appl. No.: 360,322

[22] Filed: Jun. 2, 1989

[51] Int. Cl.[5] ..... D05B 35/02

[52] U.S. Cl. ..... 112/141; 112/147; 112/304; 112/121.29

[58] Field of Search ..... 112/2, 10, 121.12, 121.15, 112/121.29, 122.3, 141, 163, 164, 165, 166, 197, 304, 322, 324

[56] References Cited

U.S. PATENT DOCUMENTS

| | | | |
|---|---|---|---|
| 1,263,088 | 4/1918 | McNeil | 112/324 X |
| 3,203,381 | 8/1965 | Crane et al. | 112/10 X |
| 3,204,590 | 9/1965 | Rockerath et al. | 112/304 X |
| 3,232,256 | 2/1966 | Buckalter | 112/10 X |
| 3,375,796 | 4/1968 | Greenberg | 112/304 X |
| 3,469,545 | 9/1969 | Hale et al. | 112/2 |
| 3,534,954 | 10/1970 | Lynch | 112/121.15 X |
| 3,782,305 | 1/1974 | Robinette | 112/10 |
| 3,906,878 | 9/1975 | Burton | 112/121.29 X |
| 4,186,676 | 2/1980 | Villa et al. | 112/165 |
| 4,204,492 | 5/1980 | Blessing | 112/121.12 X |
| 4,295,435 | 10/1981 | Vemura et al. | 112/322 |
| 4,428,315 | 1/1984 | Keeton | 112/121.12 X |
| 4,466,367 | 8/1984 | Price et al. | 112/322 X |
| 4,483,262 | 11/1984 | Keeton | 112/121.12 |
| 4,501,209 | 2/1985 | Keeton | 112/121.12 |
| 4,594,955 | 6/1986 | Lichtenberg | 112/304 X |
| 4,800,830 | 1/1989 | Adamski et al. | 112/304 X |

*Primary Examiner*—Werner H. Schroeder
*Assistant Examiner*—Paul C. Lewis
*Attorney, Agent, or Firm*—Darby & Darby

[57] ABSTRACT

An automatic feeder unit for a twin or triple needle bottom cover stitch machine which allows hemmed garments to be chained off while being sewn automatically. The feed unit comprises a top feed conveyor coupled to a synchronizer which senses the speed of the main shaft of the sewing head to control the speed of the top feed conveyor in relation to the speed of the sewing head. Further a feed dog and throat plate assembly comprises an extended land area beyond the chaining finger and having a slot located therebeyond through which a feed dog protrudes during operation, to thereby retain the chain stitch during chaining off.

10 Claims, 5 Drawing Sheets

SEWING MACHINE FOR HEMMING ARTICLES

BACKGROUND OF THE INVENTION

The present invention relates to an improved sewing machine and in particular to an automatic sewing machine for hemming tee-shirt sleeves and body panels using a twin or three needle bottom cover stitch machine for federal stitch types 406 and 407.

The present invention in one broad form comprises an automatic feeder unit, adapted for operation with a sewing head having a main shaft, comprising;

a feed conveyor;

a feed motor which drives a top feed conveyor located above said feed conveyor; and a synchronizer which is coupled to the main shaft of the sewing head, to control the speed of the feed motor in relation to the speed of the sewing head.

In another form the invention comprises:

a feed dog and throat plate assembly for an automatic sewing machine for hemming fabric and chaining off between fabric pieces comprising:

a throat plate having a first pair of longitudinally extending spaced apart parallel slots, and located therebetween, at one end, a second pair of parallel slots and a substantially c-shaped slot which forms the chaining finger, and located at or just beyond the other end a fifth slot, such that a relatively large land is formed between the chaining finger and the fifth slot sufficient to retain the chain stitch during chaining off;

a first foot assembly having two parallel feed dogs adapted to operate in the first pair of slots and a third feed dog adapted to operate in the said fifth slot; and a second foot assembly comprising four feed dogs which operate in the first and second pair of slots.

The present invention will now be described by way of example with reference to the accompanying drawings in which:

DETAILED DESCRIPTION OF THE PREFERRED EMBODIMENTS

Figure 1:
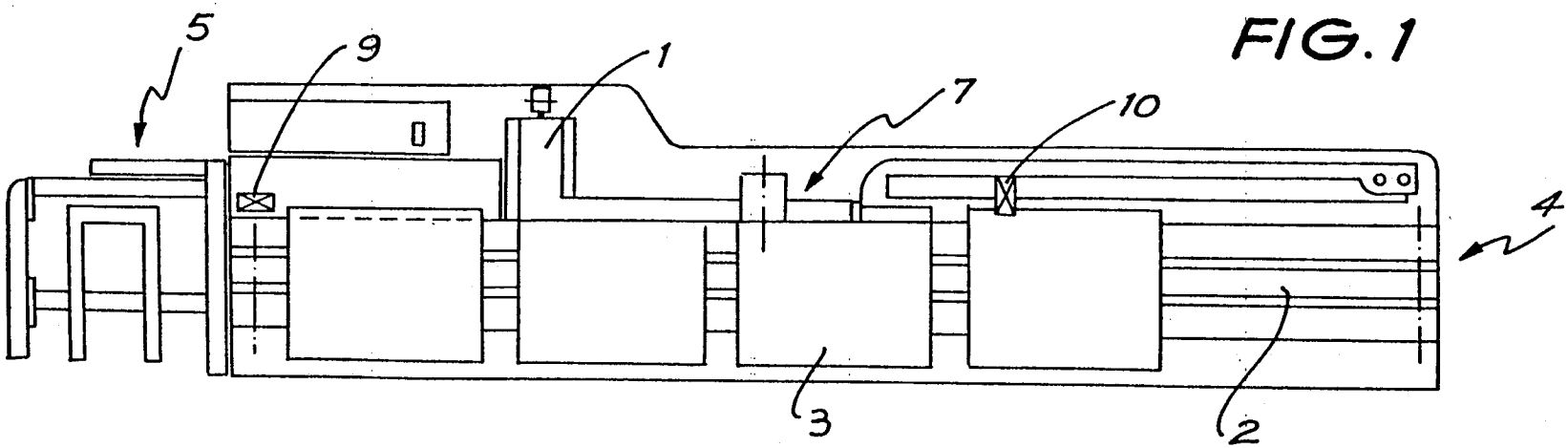
FIG. 1 illustrates a plan view of an automatic bottom cover stitch federal stitch type 406 and 407 sleeve hemmer for tee-shirts utilizing a feeder unit of one embodiment of the present invention.
Figure 2:
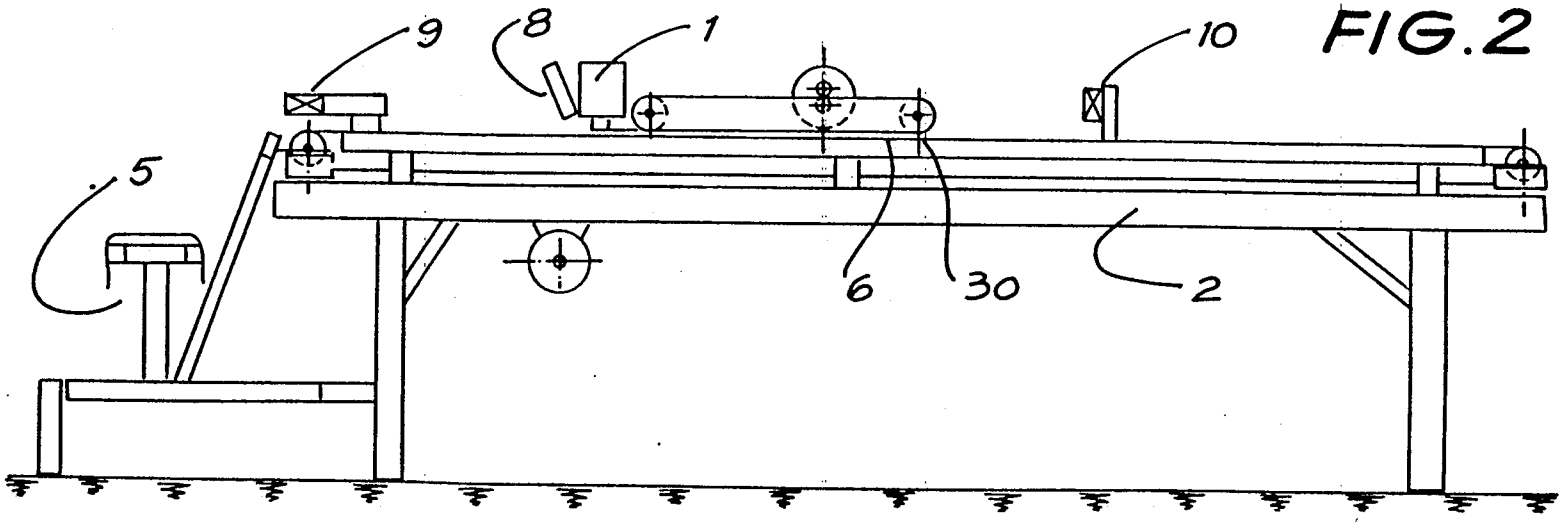
FIG. 2 illustrates an elevation view of the above hemmer.

As shown in FIG. 1 and 2, an embodiment of the present invention is utilized in a bottom cover stitch sleeve hemmer for tee-shirts. In a machine utilizing the present invention it is now possible to automate the operation of hemming tee-shirt sleeves and body panels using a twin or three needle bottom cover stitch machine (federal stitch types 406 and 407). The sewing head 1 is coupled to a conveyor 2 which transports each piece of fabric 3 along the full length of the table 4 to an automatic stacking device 5. The fabric can be prefolded before sewing and is fed into both the folder 6 and the sewing head 1 by a top feed unit 7 which controls the rate at which the fabric is fed into the machine. A trimmer 30 is located prior to the folder 6, and compresses a rotary cutter which cuts from beneath.

The fabric is firstly placed on the conveyor table 4 at a predetermined location. The conveyor 2 then transports the fabric to a top feed unit 7 which feeds the fabrics to the trimmer 30 and the folder 6 then to the sewing head 1. Once the fabric has been sewn the machine then chains off between pieces which in turn allows for automatic separation of each garment by a photocell activated chain cutter 8.

The fabric is then transported to the end of the table 4 where another photocell 9 activates the automatic stacker 5 which stacks each fabric piece neatly into a bundle. The cycle is automatically repeated.

If the operator does not re-load the fabrics to be fed to the machine quickly enough, a stop photocell 10 will automatically stop the machine thereby saving wastage of thread whilst chaining off.

Figure 3:
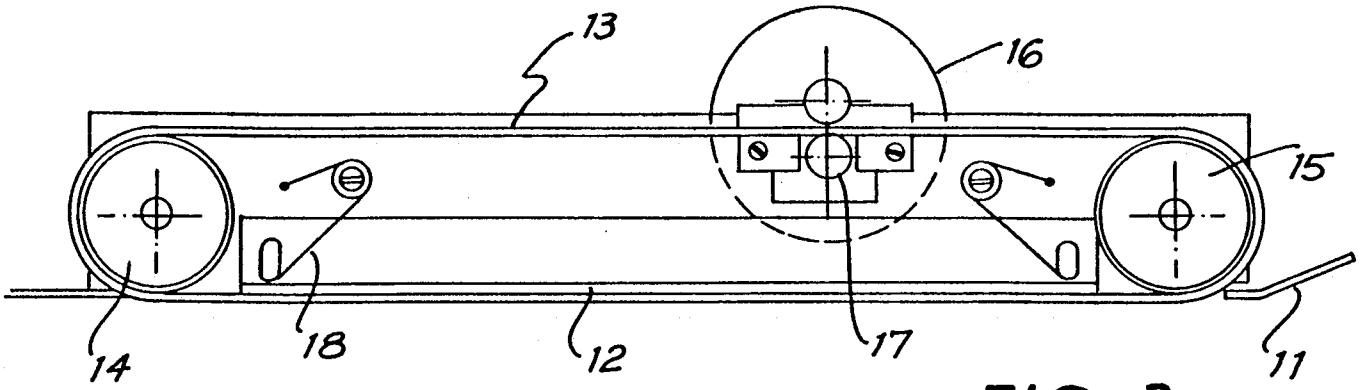
FIG. 3 illustrates a schematic plan view of a feeder unit according to one embodiment of the present invention.
Figure 4:
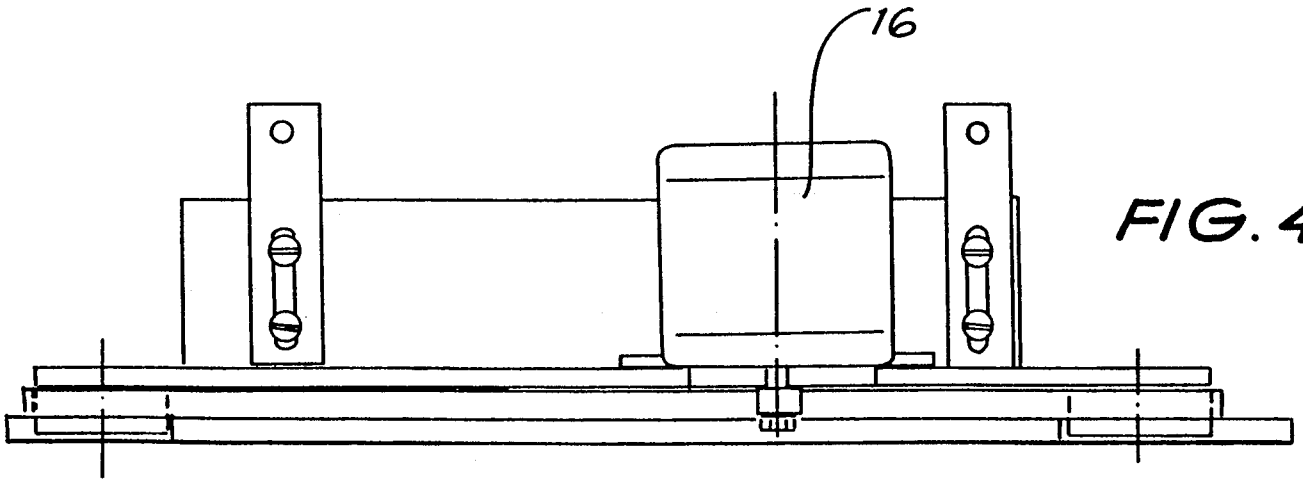
FIG. 4 illustrates a schematic elevation view of the feeder unit of FIG. 3.
Figure 8:
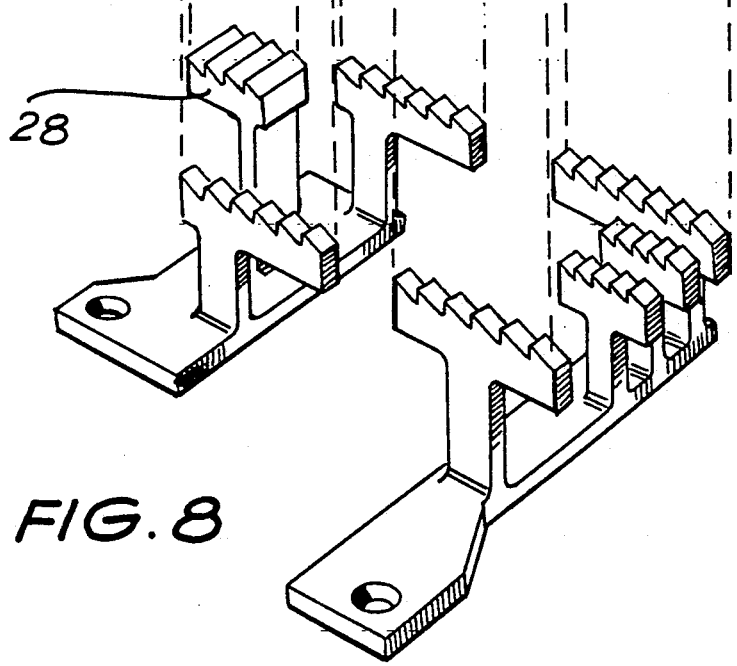
FIG. 8 illustrates the feed dogs for the throat palte of FIG. 7.

One embodiment of the top feed unit 7 is illustrated in FIGS. 3 and 4. This feed unit automatically feeds the fabric into a trimmer and a pre-folding device which then allows a tee-shirt sleeve to be automatically hemmed, and also for the controlled feed of fabric into the sewing machine. This top feed unit 7 comprises a fabric guide strip 11 located on the feed end, a pressure plate 12 and a fabric drive belt 13 which is fed around the pulleys 14 and 15. The belt is driven by a stepping motor 16 which is coupled to a synchronizer and is electronically controlled. A schematic circuitry is shown in FIG. 8. The stepping motor drives the belt 13 by way of a drive pulley 17 as shown in FIG. 3.

The synchronizer 31 is coupled to the main shaft of the sewing head 1, thus it allows for monitoring of the speed of the sewing head as it accelerates and deccelerates as well as for the feeding of the fabric at the same speed as the sewing head 1. This allows the metering of the fabric into the machine such that it is possible to allow for pre-stretch or to purposely overfeed to the sewing head at a precise metered rate to produce a flatter seam or a more precisely gathered seam as required. Further, in this embodiment, the stepping motor 16 is coupled directly to the main frame on which are mounted the idler pulleys 14 and 15, the drive pulley 17, the pressure plate 12, tension springs 18 and the drive belt 13. This produces a compact unit with a flexibility unknown to all prior art units.

Figure 9:
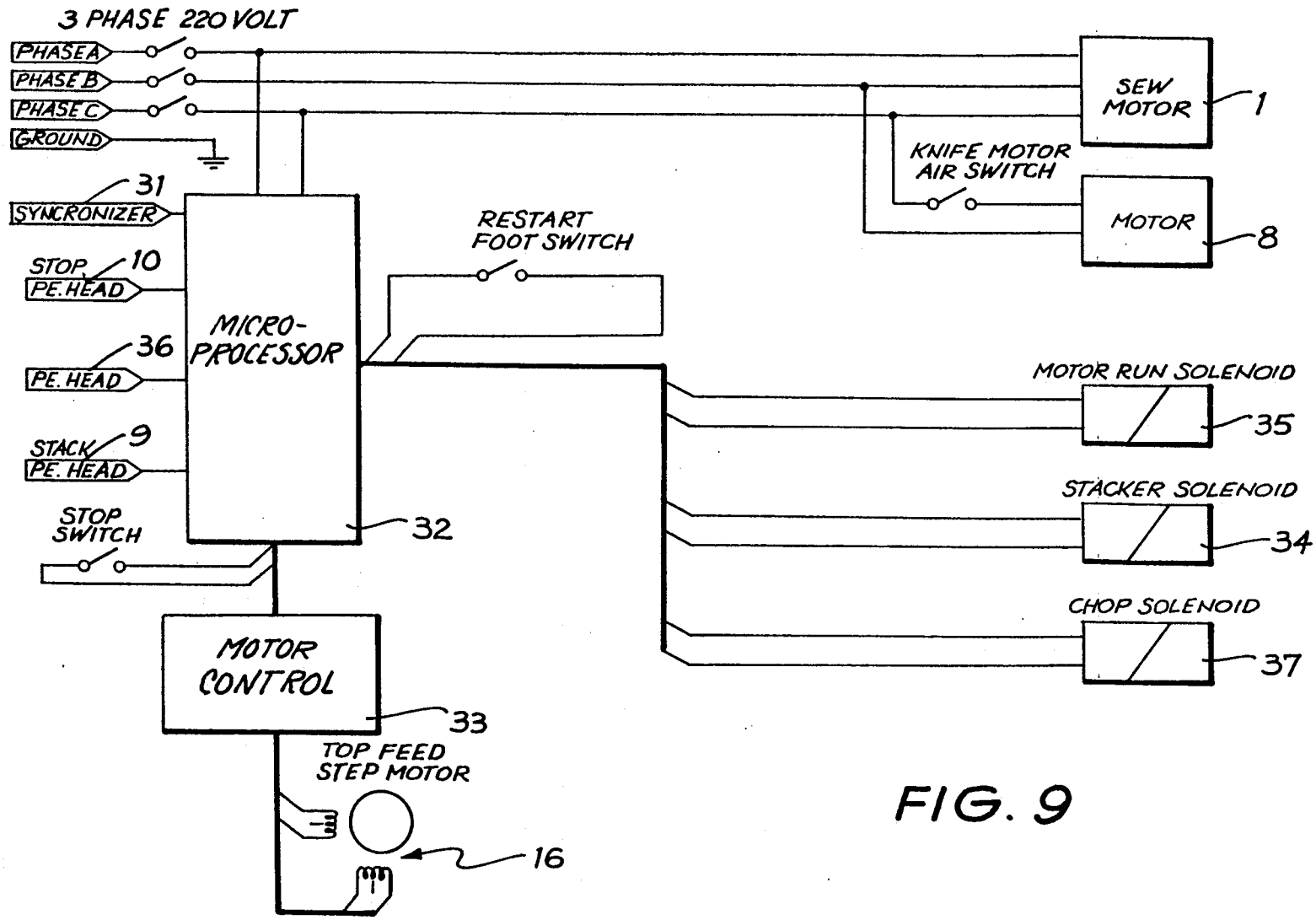
FIG. 9 illustrates schematically the electronic circuitry of one embodiment of the present invention.

The apparatus is fed by a three phase 220 volt power supply as shown in FIG. 9. The synchronizer 31 monitors the speed of the sewing head 1 and feeds this signal into the main microprocessor control 32, where a signal is then forwarded to the stepping motor controller 33 to control the speed of the top feed stepping motor 16.

The respective photocells 9, 10, and 36 are connected through the main microprocessor control 32 to operate respectively the stacker solenoid 34, the motor run solenoid 35 and chain cutter solenoid 37.

Figure 5:
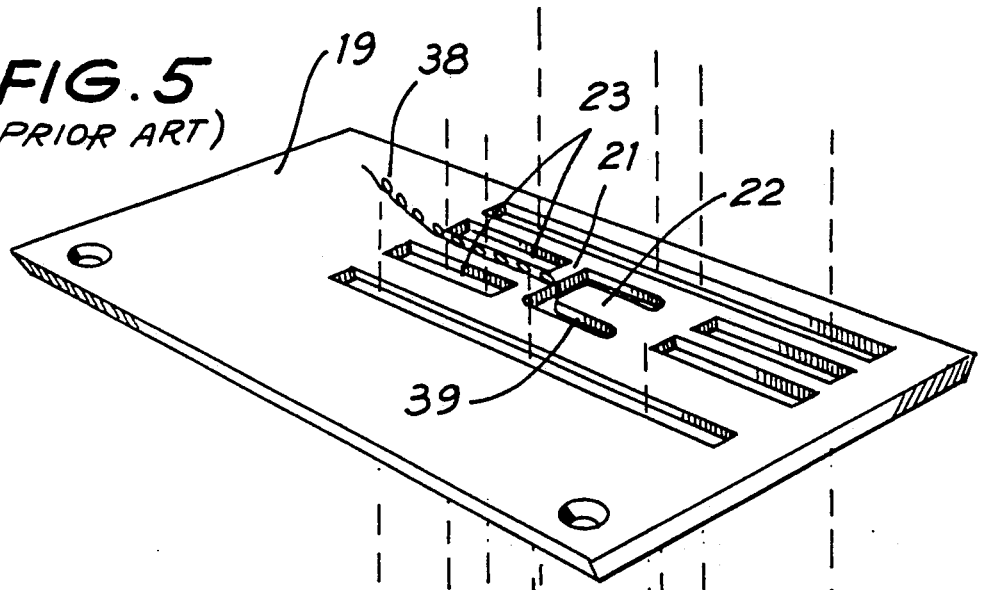
FIG. 5 (PRIOR ART)
FIG. 5 illustrates a prior art throat plate for a federal stitch type 406 and 407 bottom cover stitch machine.

One embodiment of the present invention relates to the modification of the standard throat plate 19 and its foot assembly 20. As shown in FIG. 5 the standard throat plate 19 for a twin needle machine, has a very small throat plate land 21 located between the chaining finger 22 and the central slots 23 for the feed dogs of the foot assembly.

The chain stitch 38 would extend beyond the chaining finger 22 and between the central slots 23, and would be held in place by the sewing foot (not shown), as the chain stitch 38 is cut by the chain cutter 8 to separate the hemmed fabric piece. As the feed dogs 26 rise through the slots 23 they raise the sewing foot (not shown) and free the chain stitch 38, which is pulled back into the c-shaped slot 39, and into the path of the looper (not shown) where the thread would be broken.

Figure 6:
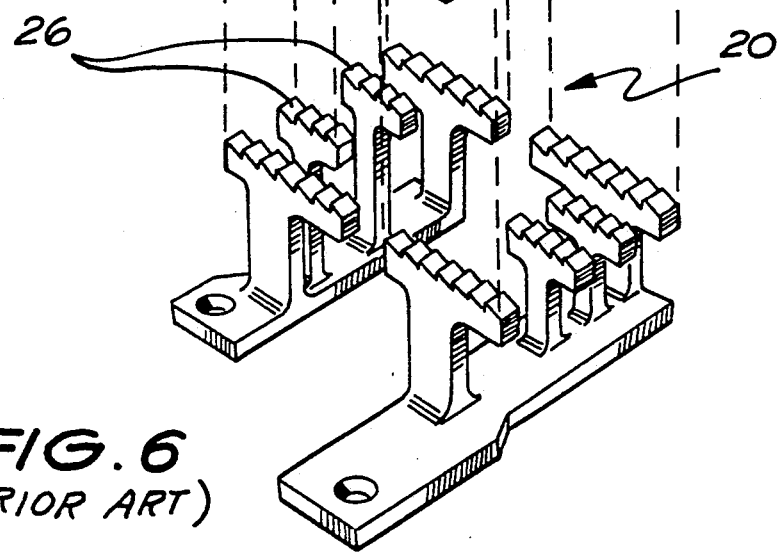
FIG. 6 (PRIOR ART)
FIG. 6 illustrates the feed dogs for the above mentioned prior art stitch machine.
Figure 7:
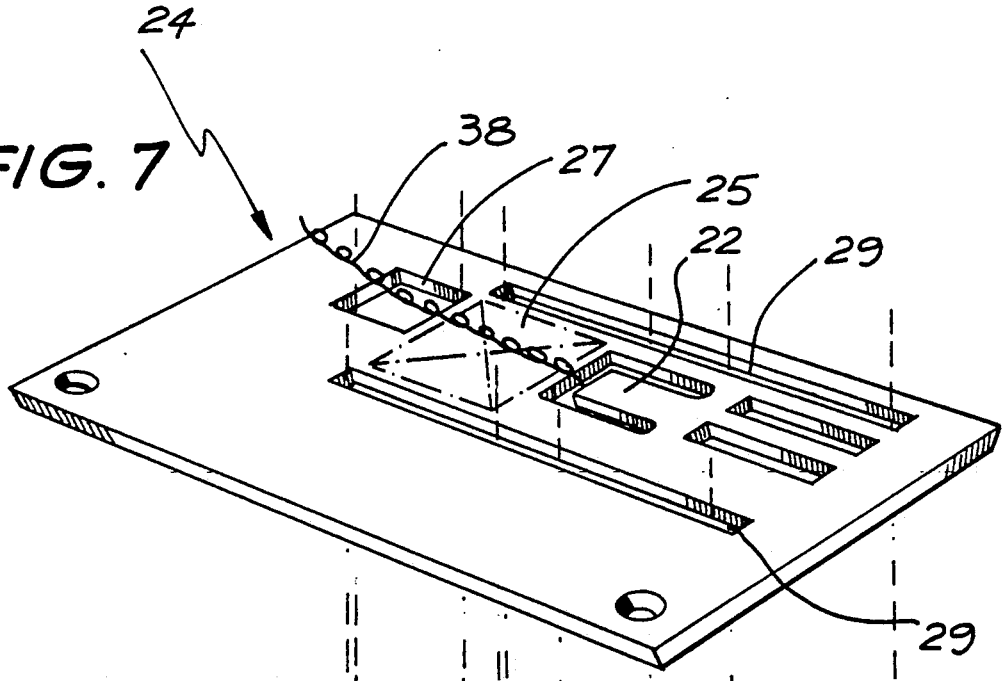
FIG. 7 illustrates one embodiment of a throat plate according to the present invention.

The throat plate 24 of the present invention is constructed differently from the standard throat plate 19 as can be seen in FIG. 7. This construction is necessary to allow the present invention to chain off while being operated automatically. The throat plate land 25 has been greatly enlarged by the removal of the central slots 23 for the middle two rows of foot dogs 26 of the foot assembly shown in FIG. 6. A slot 27 is provided for an auxiliary feed dog 28 just beyond the outer two feed dog slots 29. As can be seen in FIG. 8, the two central rows of feed dogs have been eliminated and a central auxiliary feed dog 28 has been extended at the rear of the foot to allow the auxiliary feed dog 28 to feed the chain forward whilst the land 25 stops the thread from being pulled back into the path of the looper (not shown) and being broken as would normally be the case with the prior art machine. In use the sewing foot (not shown) holds the chain stitch 38 on the land 25, however, contrary to prior art machines the chain stitch 38 lies across the central slot 27. Therefore, as the feed dogs rise through their respective slots, the auxiliary feed dog engages the chain stitch from being pulled into the path of the looper.

It should be obvious to people skilled in the art that modification and variations can be made to the above description without departing from the scope or the spirit of the present invention.

What is claimed is:

1. An automatic feeder unit, adapted for operation with a sewing head having a rotatable main shaft, comprising:

a feed conveyor;

a top feed conveyor located above said conveyor;

a stepping motor which drives said top feed conveyor;

microprocessor means for controlling the speed of the top feed conveyor at various ratios relative to the speed of the main shaft; and a synchronizer which is coupled to the main shaft, to control the speed of the motor in relation to the speed of the main shaft, said synchronizer feeding a signal to said microprocessor means toachieve said controlling of speed.

2. An automatic feed unit according to claim 1 further comprising a trimmer and folding device located before the sewing head.

3. An automatic feeder unit according to claim 2 comprising a fabric guide strip and a pressure plate in opposed relationship to the feed conveyor.

4. In combination with an automatic feeder unit according to claim 1, a feed dog and throat plate assembly comprising:

a throat plate having a first pair of longitudinally extending, spaced apart, parallel slots, and located therebetween at one end thereof, a second pair of parallel slots and a generally c-shaped slot which forms a chaining finger, and proximate the other end of said first pair of slots, a fifth slot positioned such that a relatively large land is formed between the chaining finger and the fifth slot sufficient to retain a chain stitch during chaining off;

a first feed dog assembly having two parallel dogs positioned and dimensioned to operate in the first pair of slots and a third dog feed positioned and dimensioned to operate in said fifth slot, said third feed dog acting to feed said chain stitch toward said other end; and a second feed dog assembly comprising four feed dogs which operate in the first and second pair of slots.

5. An automatic feeder unit according to claim 2, wherein said trimmer is a rotary cutter which cuts from beneath the feed conveyor.

6. A feed dog and throat plate assembly according to claim 4 wherein said first pair of longitudinally parallel spaced apart slots extend beyond the c-shaped slot.

7. A feed dog assembly according to claim 6 comprising a second feed dog and throat plate assembly wherein said fifth slot is substantially wider than the other slots and in which a correspondingly shaped feed dog engages.

8. A feed dog and throat plate assembly for an automatic sewing machine for hemming fabric and chaining off between fabric and pieces comprising:

a throat plate having a first pair of longitudinally extending spaced apart parallel slots, and located therebetween, at one end thereof, a second pair of parallel slots and a generally c-shaped slot which forms a chaining finger, and proximate another end of said first pair of slots, a fifth slot positioned, such that a relatively large land is formed between the chaining finger and the fifth slot sufficient to retain a chain stitch during chaining off;

a first feed dog assembly having two parallel dogs positioned and dimensioned to operate in the first pair of slots and a third feed dog positioned and dimensioned to operate in said fifth slot, said third feed dog acting to feed said chain stitch toward said other end; and a second feed dog assembly comprising four feed dogs which operate in the first and second pair of slots.

9. A feed dog and throat plate assembly according to claim 8 wherein said first pair of longitudinally parallel spaced apart slots extend beyond the c-shaped slot.

10. A feed dog assembly according to claim 9 comprising a second feed dog and throat plate assembly wherein said fifth slot is substantially wider than the other slots and in which a correspondingly shaped feed dog is received.

* * * * *